US006403145B1

(12) United States Patent
Montgomery

(10) Patent No.: US 6,403,145 B1
(45) Date of Patent: Jun. 11, 2002

(54) HIGH VOLTAGE THICK FILM FUSE ASSEMBLY

(75) Inventor: Jeffrey D. Montgomery, San Diego, CA (US)

(73) Assignee: American Electronics Materials, Inc., San Diego, CA (US)

( * ) Notice: Subject to any disclaimer, the term of this patent is extended or adjusted under 35 U.S.C. 154(b) by 0 days.

(21) Appl. No.: 08/715,239

(22) Filed: Sep. 16, 1996

Related U.S. Application Data

(63) Continuation of application No. 08/524,986, filed on Sep. 8, 1995, now abandoned, which is a continuation of application No. 08/148,770, filed on Nov. 4, 1993, now Pat. No. 5,479,147.

(51) Int. Cl.[7] ..... B05D 9/13
(52) U.S. Cl. ..... 427/96; 427/376.1
(58) Field of Search ..... 427/96, 376.1

(56) References Cited

U.S. PATENT DOCUMENTS

| | | | | |
|---|---|---|---|---|
| 4,093,932 A | 6/1978 | Kozacka | ..... | 337/161 |
| 4,626,818 A | 12/1986 | Hilgers | ..... | 377/166 |
| 4,771,260 A | 9/1988 | Gurevich | ..... | 337/231 |
| 5,363,082 A | 11/1994 | Gurevich | ..... | 337/227 |

FOREIGN PATENT DOCUMENTS

| | | | | |
|---|---|---|---|---|
| JP | 5144368 | 6/1993 | ..... | H01H/85/175 |
| JP | 5274994 | 10/1993 | ..... | H01H/85/12 |
| SU | 1749943 | 7/1992 | ..... | H01H/85/12 |

*Primary Examiner*—Benjamin L. Utech
(74) *Attorney, Agent, or Firm*—McGinn & Gibb, PLLC; Frederick W. Gibb, III

(57) ABSTRACT

A thick film fuse assembly for high voltage, high amperage, high reliability applications. In a first embodiment the fuse assembly consists of an insulative substrate on which a parallel array of low mass thick film fusible elements are disposed. Thick film contact pads permit attachment of lead wires in electrical contact with the fusible elements. The fusible array is covered with a coating of arc suppressant glass. In a second embodiment of the fuse assembly, the fusible elements comprise thick film end portions and upstanding conductive wires which are positioned above and away from the insulative substrate. The arc suppressant glass surrounds each of the upstanding wires which permits higher amperage capacity.

18 Claims, 6 Drawing Sheets

HIGH VOLTAGE THICK FILM FUSE ASSEMBLY

This is a Continuation of application Ser. No. 08/524,986 filed Sep. 8, 1995 now abandoned, which was a Continuation of application Ser. No. 08/148,770, filed Nov. 4, 1993, now U.S. Pat. No. 5,479,147.

BACKGROUND AND SUMMARY OF THE INVENTION

This invention relates to a thick film fuse assembly for high reliability applications. These fuses are particularly suitable for high voltage, high amperage circuits which may be operated in high vacuum environments, in which a very high degree of reliability is required. Additionally, these fuses are suitable for use in environments which may subject the fuse to relatively high levels of mechanical shock and vibration. A typical application for this type of fuse is the fusing of satellite power systems.

Thick film high reliability fuses have, in the past, been constructed with a single thick film element of conductive metal printed on a thermally insulative substrate with thick film terminations which are used to provide electrical contact with the thick film fuse element. In this context, "thick film" refers to the process of screen printing and firing electrical components on a substrate, not to the actual thickness of the components. In many cases the elements are quite thin i.e. several tenths of a micron. In the screen printing process the fuse components are patterned and printed on the substrate, the firing process of approximately one hour is used to remove the solvents and bind the components to the substrate. The fuse element is covered with a layer of arc suppressant glass which has a relatively low (450° C.) melting point. Leads are connected to the terminations and the entire package is encapsulated by an insert molding operation utilizing a high temperature thermoplastic or thermoset plastic with low outgassing characteristics.

Traditional thick film fuse assemblies (constructed with gold elements) clear (blow) in the following manner: excessive current in the fuse heats the fuse element to 450° C. which is the melting temperature of the arc suppressant glass. When the arc suppressant glass melts, the thermal equilibrium of the fuse is altered. The fuse element goes into thermal runaway which allows the element to melt at temperatures at or above 1050° C. The melted fuse element migrates into the arc suppressant glass located above it, which prevents a continued arcing process. These fuses have a limitation in that the maximum operating voltage is approximately 72 volts D.C. for fuses rated above 1 or 2 amps. However, newer satellite power systems operate above 100 volts D.C. at well above 5 amperes which renders traditional thick film fuse constructions unusable.

The reason for the voltage limitation of traditional thick film fuses is that during the overload clearing action the fuse element material (throat region) must be completely absorbed by the arc suppressant glass to prevent arcing and restriking which could result in a catastrophic failure, such as the failure of a fuse to completely open or a breaching of the fuse package. In traditional thick film fuse constructions the fuse element thickness is increased as the fuse amperage rating is increased. Thus more fuse element material must migrate into the arc suppressant glass when a 5 amp fuse is cleared than when a 1 amp fuse is cleared. At voltage levels above 72 volts D.C. the arc suppressant glass cannot reliably suppress arcing and restriking at fuse ratings greater than 1 or 2 amperes. It is believed that the larger mass of fuse element material which must migrate during clearing saturates the arc suppressant glass and decreases its ability to suppress the arc, which can promote catastrophic failure.

In the first construction of a fuse element in accordance with a present invention the fuse element consists of an insulative substrate in which a plurality of low mass thick film fuse elements are disposed in parallel on the substrate. Thick film contact pads electrically connect to the fuse elements to permit attachment of lead wires and a layer of low melting point arc suppressant material covers the fuse elements. This construction permits a higher voltage and current rating for the fuse element because the fusible element is not concentrated in one area. Thus, there is more arc suppressant glass to absorb the material of the element, which provides a more reliable fuse.

In the second embodiment of a fuse assembly in accordance with the invention the fusible elements comprise thick film, screen printed, end portions and gold wires which are positioned so as to stand above and away from the insulative substrate. This construction provides a faster initiation of the clearing action. The wire portion of the fuse element is completely surrounded by arc suppressant glass. During an overload clearing condition the arc suppressant material is better able to limit arcing and restriking because the material of the fusible element is not concentrated in one area as is the case with single element fuses. Finally, if during the clearing action the wire portion of the fuse should burn back to the thick film portion of the element the thick film portion will also migrate into the arc suppressant glass without breaching the fuse package.

BRIEF DESCRIPTION OF THE DRAWINGS

For a better understanding of the invention, reference is made to the following drawings which are to be taken in conjunction with the detailed specification to follow.

DETAILED DESCRIPTION OF THE PREFERRED EMBODIMENTS

FIGS. 1*a*–1*d* illustrate a first construction for a high-voltage thick film fuse assembly in accordance with the invention. The assembly begins with a substrate 10 for supporting the other elements of the assembly. Substrate 10 should be-thermally and electrically insulative. Substrate 10 must also be capable of withstanding the temperatures (850° C.) required for "firing" the thick film elements without warping or deforming. Additionally, substrate 10 must be able to withstand several thousand temperature cycles of −650° C. to +1250° C. as may occur during the life of the fuse. However by application of a dielectric coating, a substrate material which has good physical properties may be made electrically and/or thermally insulative. In the case at hand, substrate 10 is alumina ($Al_2O_3$) which has good physical properties but is insufficiently thermally insulative. By placing a dielectric coating 12 of high melting temperature glass (vitreous mineral filled glass with a temperature coefficient of expansion matched to that of alumina) on substrate 10, substrate 10 becomes more thermally insulative. A suitable substrate material that does not require a dielectric coating is calcium boro-silicate, which is thermally and electrically insulative and capable of withstanding high temperature processing. Additional substrate materials which have proved useful are those constructed from zirconium oxide, and alumina substrates which are formulated with a relatively high percentage of glass.

Figure 1A:
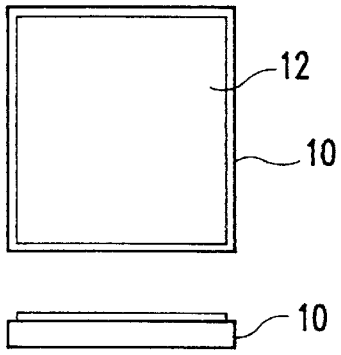
FIGS. 1*a* through 1*d* illustrate a first construction for a thick film fuse assembly in accordance with the invention, in each of the figures the upper figure is a plan view of the construction with the lower figure a side view of the construction.
Figure 1B:
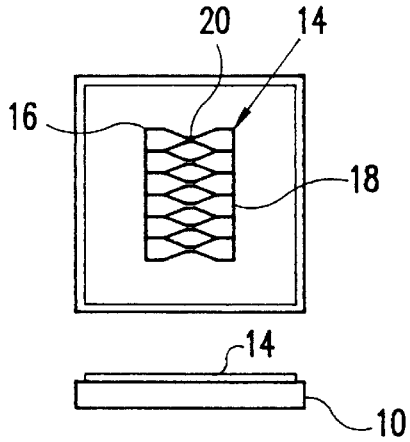
Figure 1C:
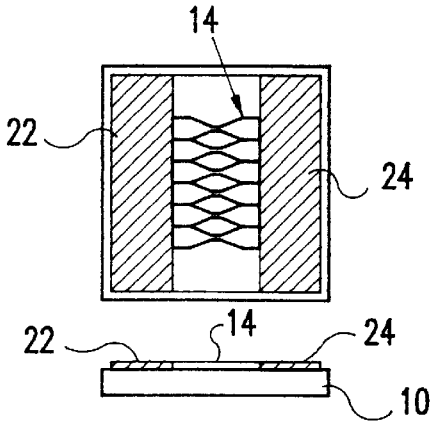
Figure 1D:
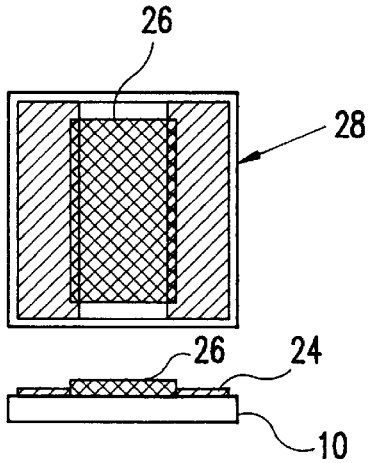

After completion of the substrate 10, the thick film fuse element 14 is disposed on substrate 10. Thick film fuse element 14 is comprised of a suitable conductive metal (such as a fritless gold) which is screen printed and fired onto dielectric coating 12 of substrate 10. As seen in FIG. 1*b*, fusible element 14 comprises end portions 16, 18 with a series of fusible links 20 extending therebetween. Fuse element 14 is thus a series of parallel fuses disposed on substrate 10. Each of the parallel fuses is an hourglass or "bow-tie" shaped fuse which are electrically and mechanically in parallel. After screen printing of fuse element 14, the entire assembly is fired at a suitable firing temperature, such as 850° C. The thickness and geometry of the fusible element 14 and the number of fusible links 20 contained therein may be adjusted in accordance with the voltage, amperage, and clear-time requirements of the desired fuse. By way of example only, a fusible element 14 comprised of gold and having a thickness of approximately 6 microns with six fusible links 20 provides a 135 volt D.C., 5 amp fuse. Of course, various combinations of the number of fusible elements and thicknesses may be used depending upon the requirements of the circuit to be protected.

After printing and firing of the fuse element 14, thick film terminations 22, 24 are screen printed and fired at 850° C. onto substrate 10. Again "thick film" terminations 22, 24 are relatively thin (approximately 20 microns) but are thicker than that of fusible element 14. Thick film terminations 22, 24 are comprised of any suitable conductive metal, such as silver, and overlay a portion of the fusible element 14 so as to provide a connection between fuse element 14 and external leads. After the placement of terminations 22, 24 on substrate 10, a thick film of low melting point arc suppressant glass is screen printed or syringe dispensed and fired at 450° C. Arc suppressant glass 26 covers all portions of fusible element 14 and extends slightly onto terminations 22, 24. Compared to the thickness of the terminations 22, 24 and fusible element 14, arc suppressant glass 26 has a much greater thickness (approximately 0.04 inches). This is to provide a sufficient mass of glass to absorb the material of fuse element 14 as the fuse clears (blows). Arc suppressant glass 26 is fired at a lower temperature than that of the other elements since it has a lower melting point in accordance with the need to melt before the clearing of fuse element 14. As will be discussed in detail below, the completed fuse assembly 28 will have leads attached to it and can be placed in a suitable external housing. A suitable glass for the arc suppressant glass 26 is lead boro-silicate glass with a thermal expansion coefficient matched to that of alumina. The glass used should have a melting temperature of 425° C. to 525° C. Glasses with high melting temperatures will result in a fuse with very slow clearing characteristics.

The fuse assembly described above provides the capability of higher voltage, higher amperage, and higher interrupt ratings than that of prior art. However, if even greater voltage amperage capacity is desired, the fuse construction illustrated in FIGS. 2*a*–2*e* may be utilized. This construction also begins with a thermally and electrically insulative substrate 40 upon which is printed and fired a dielectric coating 42 (if the substrate is not electrically and thermally insulative). Thereafter, printed on the insulative layer 42 of substrate 40 are thick film conductive fuse end portions 44, 46 which are comb-like in appearance and which extend toward each other but are electrically separate. End portions 44, 46 will be electrically bridged by fusible elements, as is described below. Screen printed and fired at the outer ends of end portions 44, 46 are thick film terminations 48, 50 which are also made of a conductive material such as silver, and which will be used for lead connection.

Figure 2A:
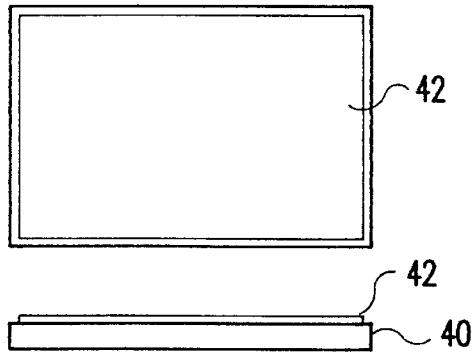
FIGS. 2*a* through 2*e* illustrates a second embodiment of a construction for a thick film fuse assembly in accordance with the invention, the upper portion of each of the figures being a plan view of the construction and the lower figure a side view thereof.
Figure 2B:
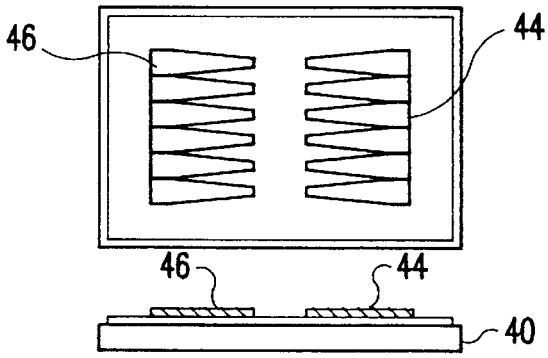
Figure 2C:
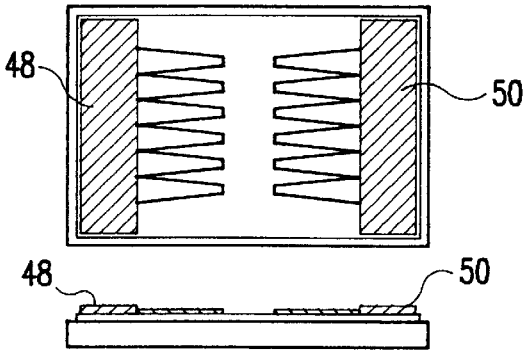
Figure 2D:
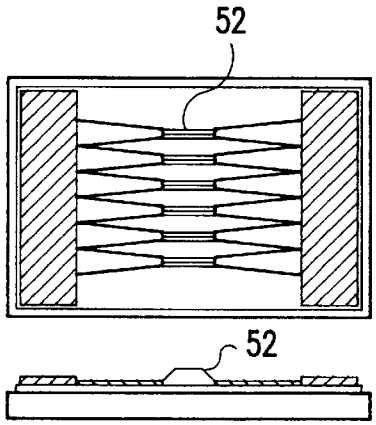
Figure 2E:
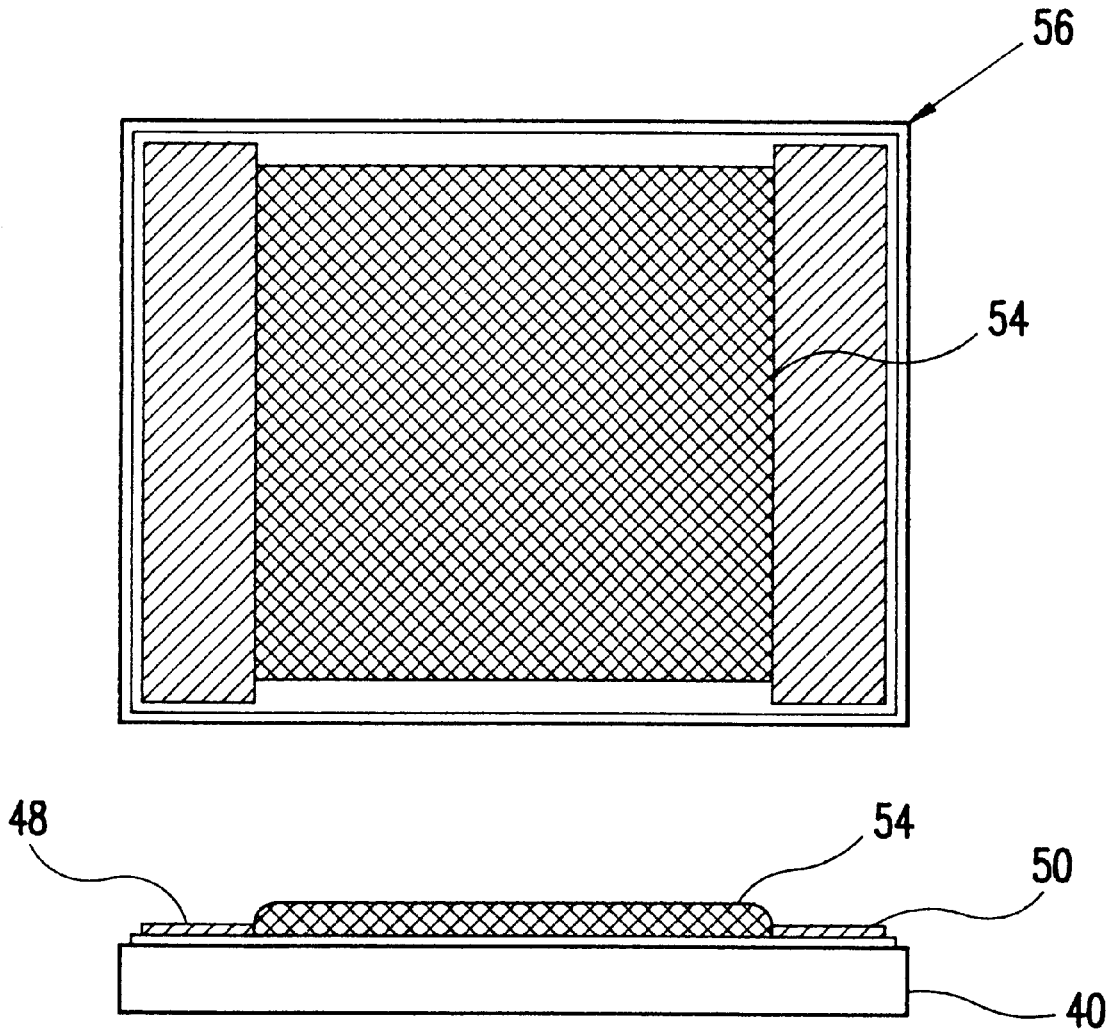

In the construction of FIG. 2*a*–2*e*, the actual fusible elements are formed by a plurality of thin conductive wires 52 which, as seen in FIG. 2*d*, are upstanding from the surface of the substrate 40. Wires 52 generally will form an arc as seen in side view (FIG. 2*d*) and are ball or wedge bonded between fuse end portions 44, 46. The number of conductive wires 52 extending between portions 44, 46 is adjusted in accordance with the voltage, amperage, and clearing requirements of the desired fuse. In certain applications only a single wire 52 need extend between end portions 44, 46. Suitable wires for this application are 0.001 inch diameter gold wires. After the wires are bonded between fuse portions 44, 46, a thick film of arc suppressant glass 54 is applied so as to cover fuse elements 44, 46 and fusible wires 52. Since fusible wires 52 are upstanding from the surface of the substrate 40, the arc suppressant glass 54 will surround wires 52 which provides greater material absorption capability when wires 52 clear. Again, as in the construction of FIG. 1, the arc suppressant glass is thicker (0.06 inches typically) than that of the other "thick film" elements. The same materials as described above with respect to FIG. 1 may be utilized in this embodiment.

Figure 3B:
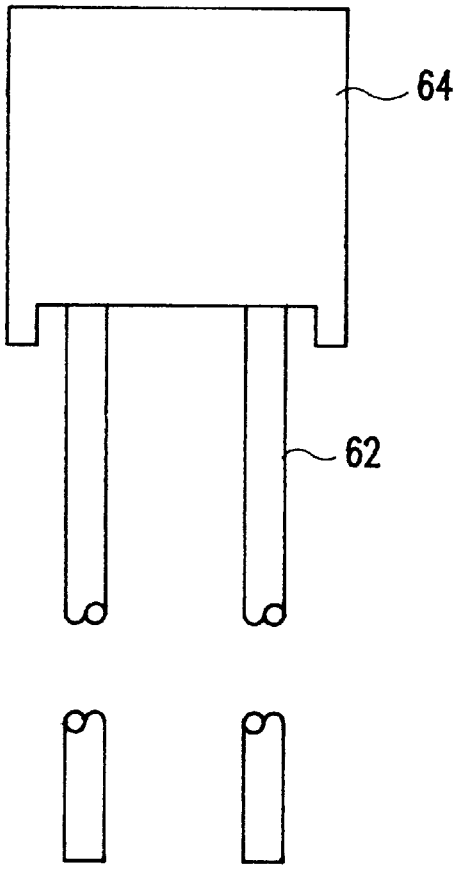
FIG. 3*b* is a plan view thereof and FIG. 3*c* is a bottom view thereof.
Figure 3A:
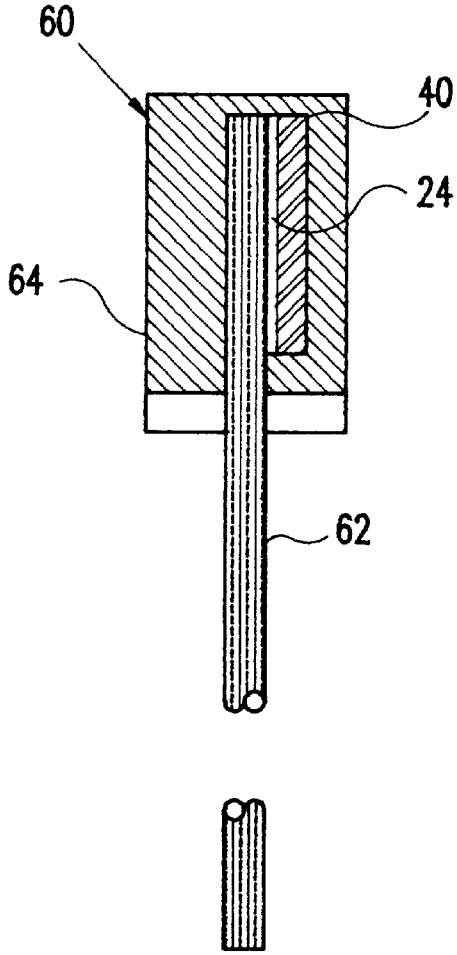
FIG. 3*a* is a cross sectional view of a fuse assembly mounted as a radial leaded package.
Figure 3C:
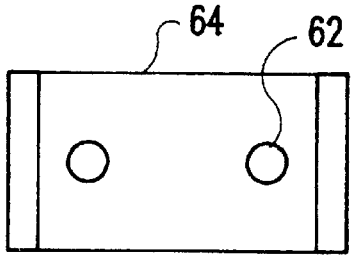

The fuse assemblies 28, 56 may be mounted in a large variety of housings for attachment to the circuit which they will operate in. FIG. 3 illustrates a radial leaded housing 60 for disposing a completed fuse assembly 28 (or fuse assembly 56). In this construction, external leads 62 are soldered to terminations 24 on substrate 10. Similarly, but not shown in FIG. 3, a second lead 62 is soldered to termination 22 on substrate 10. Thereafter, the entire assembly is inserted into a mold and a thermoplastic or thermoset housing 64 molded around it.

Figure 4C:
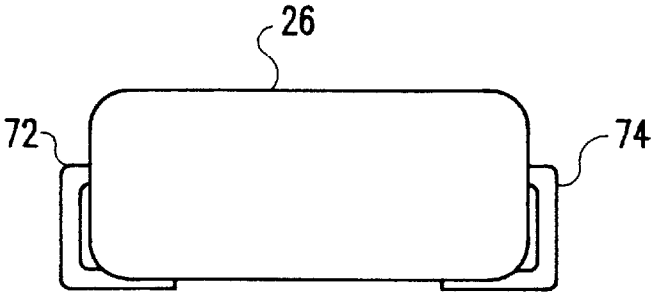
FIG. 4*b* is a side view thereof and FIG. 4*c* is a bottom view thereof.
Figure 4B:
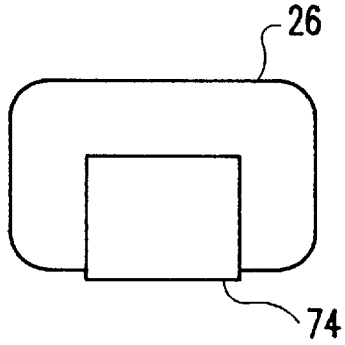
Figure 4A:
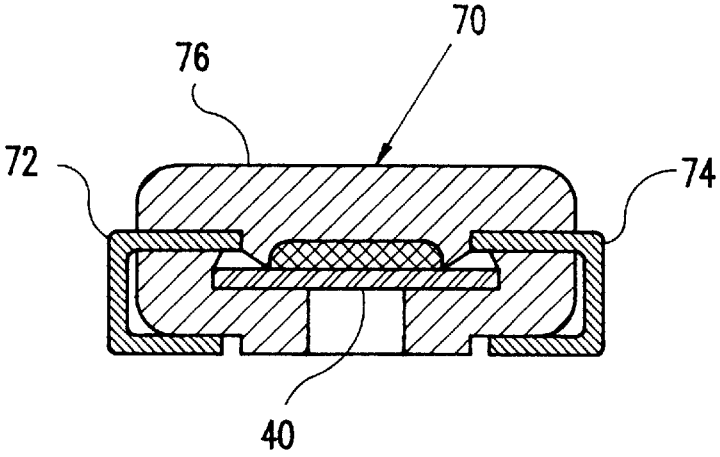
FIG. 4*a* is a cross sectional view of a fuse assembly in accordance with the invention in a surface mountable housing.

FIG. 4 illustrates a surface mountable package 70 for the fuse constructions in accordance with the invention. In this construction, "J" type leads 72, 74 are soldered to thick film terminations 48, 50 and the entire package is surrounded by a high temperature plastic molded body 76. As the "J" leads 72, 74 extend underneath the body 76, package 70 may be soldered or bonded directly to an appropriate printed circuit board.

Figure 5B:
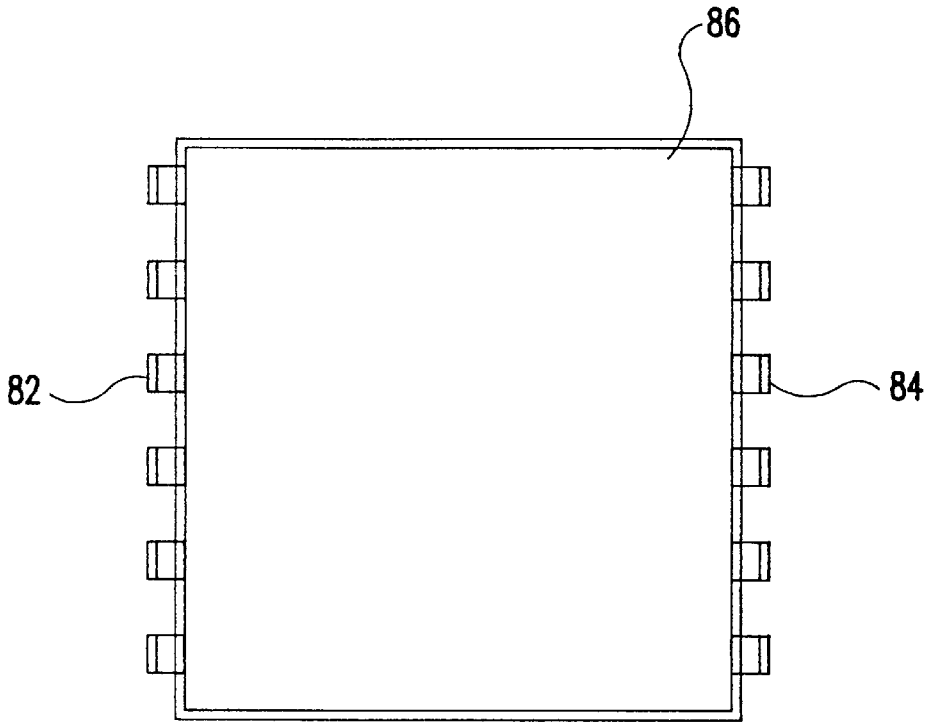
FIG. 5*b* is a plan view thereof.
Figure 5A:
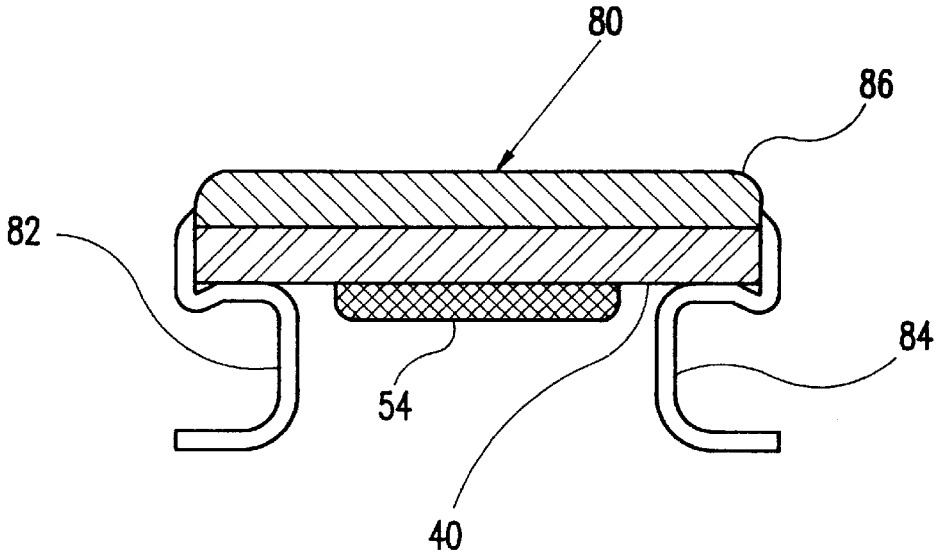
FIG. 5*a* is a fuse assembly in accordance with the invention in a surface mountable assembly with the fuse assembly exposed with the fusible element and arc suppressant glass disposed towards the bottom.

FIG. 5 illustrates a surface mountable "chip" package 80 for the fuse constructions in accordance with the invention. In this construction, "Gull Wing" type leads 82, 84 are soldered to thick film terminations 48 and 50 and the fuse assembly is mounted "upside down" with the assembly mounted so that the arc suppressant glass 54 is on the underside . A layer of epoxy 86 covers the back side of the substrate 40. As the "Gull Wing" leads 82, 84 extend underneath the substrate 40, package 80 may be soldered or bonded to an appropriate printed circuit board. The construction of the fuse assembly 28 (or fuse assembly 56) permits this type of packaging when amperage ratings do not exceed 5 amperes at 135 volts D.C. Of course, many other possible housing arrangements for use with the present fuse construction are also possible.

The above-described are merely illustrative of the principles and construction of the present invention. Numerous modifications and adaptations thereof will be readily apparent to those skilled in the art without departing from the spirit and scope of the present invention.

What is claimed is:

1. A method of manufacturing a fuse assembly comprising steps of:

providing a thermally and electrically insulative substrate;

disposing a plurality of fusible elements on the surface of said substrate;

disposing first and second terminations at the respective ends of said fusible elements; said step of disposing first and second terminations including electrically connecting said respective ends of said fuisible elements with said first and second terminations such that said fuse assembly clears by each of said plurality of fusible elements opening substantially simultaneously; and coating said fusible elements with a glass material.

2. The method as claimed in claim 1, wherein said step of providing an insulative substrate comprises coating an electrically conductive substrate with a dielectric coating.

3. The method as claimed in claim 1, further including a step of attaching lead means to said terminations.

4. The method as claimed in claim 1, further including a step of molding a housing about said fuse assembly.

5. The method as claimed in claim 1, further comprising a step of providing said plurality of fusible elements of said fuse assembly in an electrically parallel path such that said fuse assembly clears by each of said plurality of fusible elements opening substantially simultaneously.

6. The method as claimed in claim 1, wherein said step of disposing said plurality of fusible elements includes electrically connecting in parallel a plurality of thick film elements on the substrate.

7. The method as claimed in claim 1, wherein said step of disposing a plurality of fusible elements includes disposing a plurality of fusible elements, each of which comprises at least one gold wire connected in series with a first thick film gold end portion and a second thick film gold end portion.

8. The method as claimed in claim 1, wherein said step of disposing said plurality of fusible elements comprises providing fusible elements comprising first and second thick film end portions, each of said first and second thick film end portions comprising a comb-like portion having a reduced thickness than that of said first and second terminations.

9. The method as claimed in claim 8, wherein said comb-like portion having a reduced thickness comprises a neck-down area of said fuse assembly, said neck-down area having a reduced width for being a first portion of said fuse to rupture during a clearing action.

10. The method as claimed in claim 8, wherein said comb-like portion having a reduced thickness includes a portion disposed directly on said insulative substrate, each of said first and second thick film end portions extending towards the other while being electrically separate from the other.

11. A method of manufacturing a fuse assembly comprising steps of:

providing an insulative substrate;

disposing a plurality of fusible elements on the surface of said substrate, said fusible elements each including first and second thick film end portions;

disposing first and second terminations at the respective ends of said fusible elements; said step of disposing first and second terminations including electrically connecting said respective ends of said fusible elements with said first and second terminations such that said fuse assembly clears by each of said plurality of fusible elements opening substantially simultaneously; and coating said fusible elements with a glass material, wherein, upon a clearing action, a first portion of each of said fusible elements migrates into said glass material, and, if during the clearing action, said first portion burns back to the first and second thick film end portions, said first and second thick film end portions also migrate into said glass material.

12. The method as claimed in claim 11, wherein said step of providing an insulative substrate comprises coating a thermally conductive substrate with a dielectric coating, said method further including a step of attaching lead means to said terminations, and a step of molding a housing about said fuse assembly.

13. A method of manufacturing a fuse assembly comprising steps of:

providing a plurality of fusible conductive elements in an electrically parallel path on a substrate;

disposing a plurality of terminations on said substrate, said terminations being in electrical contact with said fusible elements and said fusible elements each including a first portion and first and second thick film end portions; and coating said fusible elements with a glass material, wherein, upon a clearing action, a first portion of each of said fusible elements migrates into said glass material, and, if during the clearing action, said first portion burns back to the first and second thick film end portions, said first and second thick film end portions also migrate into said glass material, and wherein said fuse assembly clears by each of said plurality of fusible elements opening substantially simultaneously.

14. The method as claimed in claim 13, wherein said step of providing a substrate comprises providing a thermally and electrically insulative substrate comprising an alumina substrate having a dielectric coating of said glass material thereon.

15. The method as claimed in claim 13, wherein said first portion comprises at least one gold wire, and wherein said step of disposing a plurality of fusible elements comprises disposing a plurality of fusible elements comprising said at least one gold wire connected in series with said first and second thick film end portions.

16. The method as claimed in claim 15, further comprising a step of forming said first and second thick film end portions such that each of said first and second thick film end portions comprises a comb-like portion having a thickness less than that of said plurality of terminations and disposed directly on said insulative substrate, extending towards the other while being electrically separate from the other.

17. The method as claimed in claim 16, wherein said at least one gold wire electrically bridges said first and second thick film end portions.

18. The method as claimed in claim 17, wherein said terminations comprise a first termination in electrical contact with said first thick film end portion and a second termination in electrical contact with said second thick film end portion.

* * * * *

UNITED STATES PATENT AND TRADEMARK OFFICE

CERTIFICATE OF CORRECTION

PATENT NO. : 6,403,145 B1
APPLICATION NO. : 08/715239
DATED : June 11, 2002
INVENTOR(S) : Montgomery It is certified that error appears in the above-identified patent and that said Letters Patent is hereby corrected as shown below:

On the title page,
Item [*] delete "0" and insert --1637--.

Signed and Sealed this

Fifth Day of December, 2006

JON W. DUDAS
*Director of the United States Patent and Trademark Office*